US005358812A

United States Patent [19]

Oide

[11] Patent Number: 5,358,812

[45] Date of Patent: Oct. 25, 1994

[54] ORGANIC PHOTOSENSITIVE DEVICE FOR ELECTROPHOTOGRAPHY AND A METHOD OF PROCESSING A SUBSTRATE OF THE DEVICE

[75] Inventor: Masaaki Oide, Utsunomiyashi, Japan

[73] Assignee: Showa Aluminum Corporation, Osaka, Japan

[21] Appl. No.: 1,539

[22] Filed: Jan. 7, 1993

[30] Foreign Application Priority Data

Jan. 14, 1992 [JP] Japan ..... 4-004685

[51] Int. Cl.[5] ..... G03G 5/047

[52] U.S. Cl. ..... 430/58; 430/60; 430/65; 430/131

[58] Field of Search ..... 430/58, 60, 65, 131

[56] References Cited

U.S. PATENT DOCUMENTS 5,162,185 11/1992 Fukuda et al. ..... 430/65
5,219,691 6/1993 Fukuda et al. ..... 430/65

FOREIGN PATENT DOCUMENTS 1421477 10/1968 Fed. Rep. of Germany .
57-029595 2/1982 Japan .
A1108551 4/1989 Japan .
A1205091 8/1989 Japan .
A1244469 9/1989 Japan .
A1274157 11/1989 Japan .
A2270130 11/1990 Japan .
A3109563 5/1991 Japan .

*Primary Examiner*—John Goodrow
*Attorney, Agent, or Firm*—Tilton, Fallon, Lungmus & Chestnut

[57] ABSTRACT

The step of conducting an anodic oxidation of an aluminum substrate in a sulfuric acid bath, and the further step of conducting an anodic oxidation of the aluminum substrate in an organic acid bath, are conducted in this order, with the organic acid capable of staining the substrate. In this way, an anodized stained membrane having a thickness of 0.5–4 μm is formed on the substrate so as to be covered with a sulfate membrane which is 3–20 μm thick. An evenly roughened interface is provided between the stained membrane and the sulfate membrane in such a state that the light beam incident upon or reflected by the surface of the substrate is refracted in a diffused manner. A photosensitive layer composed of an organic material is formed on the sulfate membrane.

20 Claims, 1 Drawing Sheet

ORGANIC PHOTOSENSITIVE DEVICE FOR ELECTROPHOTOGRAPHY AND A METHOD OF PROCESSING A SUBSTRATE OF THE DEVICE

TECHNICAL FIELD AND BACKGROUND ART

The present invention relates to an organic photosensitive device for electrophotography, and also to a method of processing a raw substrate of the device, wherein the electrophotography employs a monochromatic coherent light such as the laser used as an illuminate for exposing a photosensitive drum in the laser beam printers.

The word "aluminum" in this specification includes its alloys.

The photosensitive devices for electrophotography comprise in general a conductive substrate which is made of aluminum or its alloy and covered with a photosensitive layer. Inorganic photoconductive materials such as selenium have been used widely as the material of the photosensitive layer, but nowadays they are being replaced with organic photosensitive devices ( i.e., "OPC" devices). These organic devices are made from organic materials, are therefore advantageous in their higher film formability, their lighter weight and their lower manufacture cost.

Efforts have been made to improve the function and efficiency of the organic photosensitive devices. The so-called laminated type of such an organic device was recently proposed, which comprises a charge generating layer (abbr. "CGL") and a charge transmitting layer (abbr. "CTL").

The organic photosensitive device of laminated type is used to record thereon digital picture signals, and in one of the proposed systems, the surface of said device is scanned or swept by a laser beam so as to form an electrostatic latent image as in the laser-beam printers (abbr. "LBP"). Usually, a semiconductor laser which emits the laser beam having a wavelength of about 650–820 nm is employed in those systems.

The laser beam is however one of the coherent monochromatic light beams. A beam portion pierces a photosensitive layer to be reflected by the inner surface of an underlying substrate is thus likely to interfere with another beam portion reflected by the outer surface of the photosensitive layer. As a result, interference fringes are often produced on solid zones of a recorded image (especially of an intermediate gradational tone) to thereby cause an intolerable uneveness of density.

It was already proposed to reflect in a diffused manner the light beam incident upon the surface of a conductive substrate when it is exposed to the light. Such a proposal employs the liquid honing process (as shown in the Patent Laying-Open Gazette 50-98327, 1975), or the superfinishing process (ibid. 50-27496, 1975 ), in order to reduce the intensity of reflected light beam by making rough the substrate surface.

It is however difficult for such a measure to practically provide the substrate surface with a uniform roughness, because an overall undulation and/or local corrugations are produced to decrease the surface charge.

OBJECTS AND SUMMARY OF INVENTION

A first object of the present invention is, therefore, to provide an organic photosensitive device comprising a substrate and free from any intolerable uneveness in image density, which uneveness has been inevitable due to the interference of coherent monochromatic light beam such as a laser beam used to make an electrostatic latent image in the electrophotography.

A second object of the invention is to provide a method of processing a raw plate to form the substrate which constitutes an organic photosensitive device employed in the electrophotography.

In order to achieve the first object, the invention provides an organic photosensitive device, which is employed in the electrophotography using a coherent monochromatic light beam as the light source, and which comprises an aluminum substrate, an anodized stained membrane formed on the substrate, an anodized sulfate membrane formed on the stained membrane, and a photosensitive organic layer formed on the sulfate membrane, wherein the stained membrane is 0.5–4 μm thick and the sulfate membrane is 3–20 μm thick.

In order to achieve the second object, the present invention provides a method of processing a raw aluminum plate to form a substrate in an organic photosensitive device, the method comprising the steps of: subjecting the raw plate to a first anodic oxidation in a sulfuric acid bath so as to provide an anodized sulfate membrane which is 3–20 μm thick and formed on the substrate; and thereafter subjecting the raw plate to a second anodic oxidation in an organic acid bath so as to provide an anodized stained membrane which is 0.5–4 μm thick and formed under the already formed sulfate membrane on the substrate, wherein the organic acid is such as rendering colored the stained membrane so that the photosensitive device is employable in the electrophotography using a coherent monochromatic light beam as the light source.

Other objects and advantages of the invention will become apparent from the description given below referring to the accompanying drawings.

DETAILED DESCRIPTION OF INVENTION AND EMBODIMENTS

The raw aluminum material forming a substrate need not be of any specified type or kind, but may be selected from those which are easy to machine, of a sufficient strength and of a moderate hardness. Generally, pure aluminum or its malleable alloys included in A3000 or A6000 series may preferably be employed herein.

An aluminum substrate is subjected at first to anodic treatment using a sulfuric acid solution so that anodic oxidation occurs on the surface of the substrate, whereby a sulfate anodized membrane is formed thereon. This treatment forming the sulfate membrane is effective not only to rigidly secure a photosensitive layer onto the surface of the substrate but also to prevent electric charge from entering the substrate. The thickness of the sulfate membrane must be from 3 μm to 20 μm. If this membrane is thinner than 3 μm, the photosensitive layer cannot be held tight on the substrate, and further the charge barrier effect of said membrane would be insufficient. However an excessive thickness greater than 20 μm is useless, because the abovementioned effects cannot be improved any more, but an increase energy consumption and an elongated process time for that treatment will impair the productivity. The sulfate membrane which is thicker than said upper limit will also inevitably increase the number of ions catched in minute holes in said membrane to thereby cause a noise in the recorded image in electrophotography. Thus, the more preferable thickness of the sulfate membrane is 5–10 μm. Insofar as this requirement is met, other conditions of the anodic treatment in the sulfuric acid bath need not be specified herein.

Any pretreatment such as de-fatting, washing in water and/or etching processes may be done, if necessary, before the fist anodic treatment described above.

Figure 1:
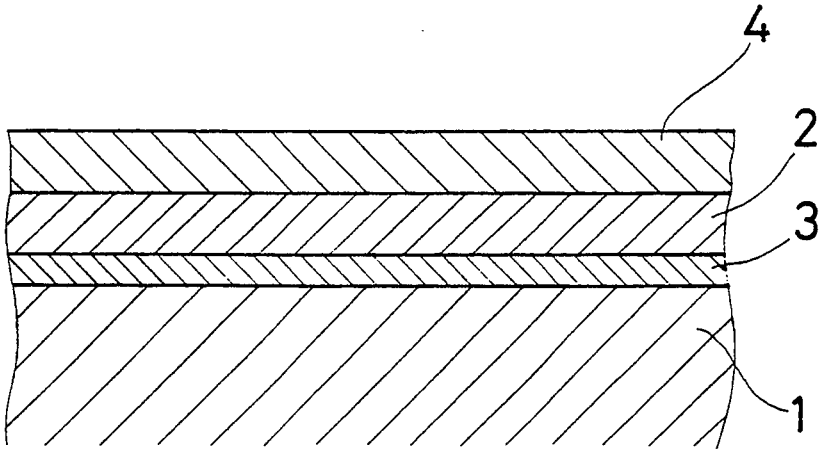
FIG. 1 is a cross section showing an organic photosensitive device which is provided by the invention for use in electrophotography.
Figure 2:
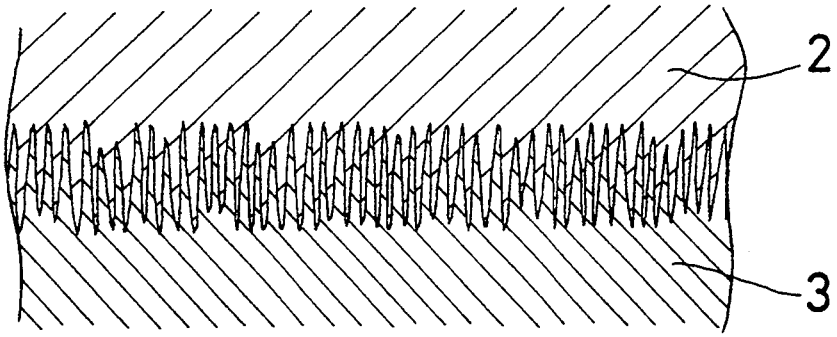
FIG. 2 is an enlarged cross section illustrating a boundary between a sulfate membrane and an anodized stained membrane which constitute the photosensitive device shown in FIG. 1.

Subsequently, a second anodic treatment is carried out in a bath of organic acid which can stain the surface of substrate. During this process, an anodized stained membrane 3 will grow between the aluminum substrate 1 and the anodized sulfate membrane 2, as shown in FIG. 1. In this way, the sulfate membrane which has previously been formed will cover the newly formed stained membrane 3. The stained membrane 3 generated in this manner will produce, between it and the sulfate membrane 3, a boundary surface which is rugged and comprises a number of extremely minute protrusions as shown in FIG. 2. Those minute protrusions are formed uniform over the entire boundary surface, and are effective to refract in a random manner the light beams incident upon or reflected from the substrate surface. Such a random refraction will diminish the interference of these light beams with the other light beam which is reflected in a diffused manner by the outer surface of a photosensitive layer, without significantly reducing the electrostatic charge thereof. It is still another advantage that the anodized stained membrane 3 does absorb a portion of the incident or reflected light beam, so that the interference between the light beams is further suppressed. In order to ensure this effect, the anodized stained membrane must have a thickness of 0.5–4 μm. With the thickness being smaller than 0.5 μm, the effect of suppressing the light beam interference will be poor, while a thickness greater than 4 μm causing an energy loss and failing to improve said effect above a saturated level. Thus, a more desirable range of the anodized stained membrane is form 0.5 to 3 μm.

The bath for producing the anodized stained membrane 3 may be of any appropriate composition, so long as it contains an organic acid capable of staining the surface of the substrate. Preferable examples of the organic acid include: oxalic acid; maleic acid; phenolsulfonic acid; sulfophthalic acid; sulfosalicylic acid; and cresolsulfonic acid. Any of these organic acids may be used alone or in any combination. Alternatively, one or more of such staining organic acids may be used in combination of an inorganic acid such as sulfuric acid. Concentration of the acids as well as the bath temperature are not restricted to any level or range.

It is recommended to dip the anodized substrate in a solution of nickel acetate or the like so as to seal the minute holes present in the substrate or membranes. This treatment is effective to render stable the recorded images, by reducing noise which would otherwise appear therein.

The conductive substrate, which has undergone the preceding processes in the described manner, will then be subjected to a further treatment such that an organic photosensitive layer 4 is formed to cover the outer surface of the sulfate membrane. This layer may be of for example the laminated type composed of a charge generating sublayer and a charge transmitting sublayer. Any conventional common substances may be used to form the photosensitive layer. Examples of the photoconductive materials for the charge generating sublayer include organic pigments such as: phthalocyanine; azoquinacridon; polycyclic quinones; perylene; indigo; and benzimidazole. More preferable substances are phthalocyanine itself or its complexes and azoic pigments, wherein the complexes each comprise a coordinate metal atom, coordinate metal oxide or coordinate metal chloride (such as copper, indium chloride, gallium chloride, tin, titanium oxide, zinc and vanadium). The azoic pigments include monoazo-, bisazo-, trisazo- and polyazo-compounds.

The charge generating sublayer may be either the above substance without any additives, or any fine dispersion of the substance in an appropriate binder. Examples of the binder are: polyvinyl butyral resins; phenoxy resins; epoxy resins; polyester resins; acrylic resins; methacrylic resins; polyvinyl acetate resin; polyvinyl chloride resin; methyl cellulose; and polycarbonate resins. 20–300 parts by weight, or more desirably 30–150 parts by weight, of the selected photoconductive substance may be blended with 100 parts by weight of the selected binder resin. The thickness of the charge generating sublayer may generally be controlled to be 5 μm or less, or more preferably 0.01–1 μm.

A material which can transmit electric charge and form thus the charge transmitting sublayer is a specified polymer or a specified low molecular-weight compound, and the former including polyvinyl carbazole, polyvinyl pyrene, and polyacenaphthylene. Examples of the latter compound are: pyrazoline derivatives, oxazole derivatives, hydrazone derivatives and stilbene derivatives. A proper binder resin may be blended with the selected charge transmitting material.

Preferable examples of the binder resin are: polymethyl methacrylate; polystyrene; vinyl homopolymer or copolymer such as polyvinyl chloride; polycarbonate; polyester; polysulfone; phenoxy resin; epoxy resin; and silicone resin. Alternatively, any cross-linkaged and partially hardened products of these materials may be employed. It is preferable to blend 30–200 parts, especially 50–150 parts by weight of the charge transmitting material with 100 parts by weight of the binder resin.

Any useful additive such as antioxidant or sensitizer may be incorporated in the charge transmitting sublayer, if necessary.

Usually, the thickness of the charge transmitting sublayer is 10–40 μm, or more desirably 10–25 μm.

In summary, according to the present invention, the raw aluminum substrate 1 is subjected to the first anodic treatment in the sulfuric acid bath, before subjected to the second anodic treatment in the organic acid bath, wherein both the treatments are for the anodic oxidation of the surface of substrate, and which substrate is stained with the organic acid during the second treatment. As a result, the anodized stained membrane 3 which is 0.5–4 μm thick and the anodized sulfate membrane 2 which is 3–20 μm thick are formed in this order on the surface of said substrate 1. The interface this order on the surface of said substrate 1. The interface formed between the stained membrane 3 and the sulfate membrane 2 is roughened evenly, whereby the light beam incident upon or reflected by the substrate surface is refracted in such a random manner that this beam will hardly interfere with the other light beam reflected by the surface of the photosensitive layer. A portion of the irradiated or reflected light beam will be absorbed by the stained membrane 3, so that the interference of one beam with other will be suppressed further.

The presence of the sulfate membrane 2 is effective not only to tightly bond the photosensitive layer 4 to the substrate 1, but also to prevent the charge from migrating into the substrate. When an electrostatic latent image is recorded on the organic photosensitive device, any interference fringes are not produced even if a coherent monochromatic light beam such as laser beam is used to scan the surface of said device. Any intolerable uneveness in density is not produced in a solid image ( especially of intermediate gradational tones ) and consequently the quality of recorded images is improved, because no interference takes place between one light beam reflected by the substrate surface and the other beam reflected by the photosensitive layer surface.

Since the surface of the substrate itself is not roughened in the present invention, in contrast with the conventional liquid honing or superfinishing process, the diffused reflection of laser beam or the like is ensured without reducing the surface charge of the photosensitive layer.

EXAMPLES

Four raw pipes were prepared by the drawing method using an aluminum alloy "A3003-H14", and then machined to provide aluminum substrates whose surface roughness grade was 0.5S.

Each substrate was pre-treated by subjecting to the steps of: de-fatting (using a surface active agent "JCB-12A" made by Nippon C. B. Chemical Co., Ltd., at its concentration of 30 g/l, and at 65° C. for 5 minutes ); washing with water; neutralization (using 13 w/v% of $HNO_3$, at room temperature for 2 minutes); and washing with water.

The pre-treated substrates were subsequently subjected to a main treatment as follows.

Reference No. 1

Anodic oxidation was carried out in a 140 g/l sulfuric acid solution at 20° C., with a current density of 1 A/dm$^2$, for 20 minutes. A sulfate membrane having a thickness of 6 μm was formed as a result of anodic oxidation.

Example No. 1

After a first anodic oxidation process was conducted under the same condition as Reference No. 1, the substrate was subjected to a second anodic oxidation process in a bath composed of 100 g/l of maleic acid and 5 g/l of sulfuric acid, at 20 ° C., with a current density of 2 A/dm$^2$, for 5 minutes. An anodized stained membrane having a thickness of 3 μm was formed as a result of anodic oxidation.

Example No. 2

After a first anodic oxidation process was conducted under the same condition as Reference No. 1, the substrate was subjected to a second anodic oxidation process in a bath composed of 100 g/l of sulfosalicylic acid and 5 g/l of sulfuric acid, at 20 ° C., with a current density of 2 A/dm$^2$, for 5 minutes. An anodized stained membrane having a thickness of 3 μm was formed as a result of anodic oxidation.

Example No. 3

After a first anodic oxidation process was conducted under the same condition as Reference No. 1, the substrate was subjected to a second anodic oxidation process in a bath composed of 100 g/l of sulfophthalic acid and 5 g/l of sulfuric acid, at 20 ° C., with a current density of 2 A/dm$^2$, for 5 minutes. An anodized stained membrane having a thickness of 3 μm was formed as a result of anodic oxidation.

Subsequently, an aftertreatment was carried out for the substrates which had been prepared according to Reference No. 1 and Example Nos. 1–3. In detail, after washing twice in water, each substrate was subjected successively to the hole-sealing treatments in a 10 g/l nickel acetate solution at 80 ° C. for 5 minutes and then in hot water at 95 ° C. for 5 minutes.

The anodic-oxidized membranes were observed for each of the substrates in Example Nos. 1–3 by taking an enlarged microscopic picture. A boundary surface between the sulfate membrane and the anodized stained membrane was confirmed to be of a roughened configuration as shown in FIG. 2.

A photosensitive layer comprising a charge generating sublayer (i.e., CGL) and a charge transmitting sublayer (i.e., CTL) was formed in this order to cover the surface of each substrate, in the following manner. The CGL having a thickness of 0.5μm was produced by applying to the substrate a tetrahydrofuran solution containing 4 % of metal-free phthalocyanine, and drying the substrate. The CTL having a thickness of 20 μm was produced by applying to the substrate a methylene chloride solution containing CT agent (i.e, charge transmitting agent) and CT resin at a ratio of 1 to 2, and drying the substrate. A compound having a hydrazone group used as the CT agent, with a polycarbonate being employed as the CT resin.

Photosensitive devices which were manufactured in this way were then tested as to the image quality. In detail, each photosensitive device was set in place on a laser beam printer, corona-charged to a voltage of −700 V, and exposed to a laser beam controlled to change the surface voltage to −150 V. Dot pattern images made in this way to be of an intermediate gradational tone were evaluated as to their uneveness in image density which would be caused by interference fringes. There was observed no interference fringes in the images made on the photosensitive devices which each had been anodic-oxidized in the sulfuric acid bath and the organic acid bath according to the Example Nos. 1–3, whereas the image on the device of Reference No. 1 employing only the anodic oxidation in sulfuric acid bath did show intolerable interference fringes. Therefore, the photosensitive device as well as the method of making same in accordance with the present invention are effective to avoid the density uneveness caused by interference fringes.

What is claimed is:

1. A photosensitive device for use in electrophotography employing as its light source a coherent monochromatic light beam, the device comprising:

an aluminum substrate;

an anodized stained membrane formed on the aluminum substrate and having a thickness of 0.5–4μm;

an anodized sulfate membrane covering the anodized stained membrane and having a thickness of 3–20μm;

the interface between the stained membrane and the sulfate membrane being rugged; and a photosensitive layer made of an organic material and covering the sulfate membrane.

2. A device as defined in claim 1, wherein the photosensitive layer is composed of a charge generating sublayer and a charge transmitting sublayer.

3. A device as defined in claim 1, wherein the anodized stained membrane is formed by anodic oxidation in a mixed solution containing one or more organic acids selected from a group consisting of oxalic acid, maleic acid, phenolsulfonic acid, sulfophthalic acid, sulfosalicylic acid and cresolsulfonic acid.

4. A device as defined in claim 1, wherein the anodized stained membrane is 0.5–3μm thick.

5. A device as defined in claim 1, wherein the anodized sulfate membrane is 5–10μm thick.

6. A device as defined in claim 1, wherein the photosensitive layer is composed of a charge generating sublayer and a charge transmitting sublayer, and wherein the anodized stained membrane is 0.5–3μm thick.

7. A device as defined in claim 1, wherein the anodized stained membrane is formed by anodic oxidation in a mixed solution containing one or more of organic acids selected from a group consisting of oxalic acid, maleic acid, phenolsulfonic acid, sulfophthalic acid, sulfosalicylic acid and cresolsulfonic acid, and wherein the anodized stained membrane is 0.5–3μm thick.

8. A device as defined in claim 1, wherein the anodized stained membrane is formed by anodic oxidation in a mixed solution containing one or more of organic acids selected from a group consisting of oxalic acid, maleic acid, phenolsulfonic acid, sulfophthalic acid, sulfosalicylic acid and cresolsulfonic acid, and wherein the anodized stained membrane is 0.5–3μm thick, with the anodized sulfate membrane being 5–10 μm thick.

9. A photosensitive device for use in electrophotography employing as its light source a coherent monochromatic light beam, the device comprising:

an aluminum substrate;

an anodized stained membrane formed on the aluminum substrate and having a thickness of 0.5–4μm;

the anodized stained membrane being formed by anodic oxidation in a mixed solution containing one or more organic acids selected from a group consisting of oxalic acid, maleic acid, phenolsulfonic acid, sulfophthalic acid, sulfosalicylic acid and cresolsulfonic acid;

an anodized sulfate membrane covering the anodized stained membrane and having a thickness of 5–10μm;

a photosensitive layer made of an organic material and covering the sulfate membrane; and the photosensitive layer being composed of a charge generating sublayer and a charge transmitting sublayer.

10. A method of processing a raw aluminum plate from which an aluminum substrate of a photosensitive device is manufactured for use in electrophotography employing as its light source a coherent monochromatic light beam, the method comprising the steps of:

conducting anodic oxidation of the raw aluminum plate in a sulfuric acid bath so as to form a sulfate membrane having a thickness of 3–20μm; and subsequently and further conducting anodic oxidation of the raw aluminum plate on which the sulfate membrane has been formed, in an organic acid bath capable of staining the raw aluminum plate so that an anodized stained membrane is formed on the surface of said aluminum plate to provide the aluminum substrate, wherein the anodized stained membrane is made to have a thickness of 0.5–4μm.

11. The method as defined in claim 10, further comprising the step of forming a photosensitive layer on the sulfate membrane, wherein the layer is composed of a charge generating sublayer and a charge transmitting sublayer.

12. The method as defined in claim 10, wherein the anodized stained membrane is formed by anodic oxidation in a mixed solution containing one or more organic acids selected from a group consisting of oxalic acid, maleic acid, phenolsulfonic acid, sulfophthalic acid, sulfosalicylic acid and cresolsulfonic acid.

13. The method as defined in claim 10, wherein the anodized stained membrane is made to have a thickness of 0.5–3μm.

14. The method as defined in claim 10, wherein the anodized sulfate membrane is made to have a thickness of 5–10μm.

15. The method as defined in claim 10, further comprising the step of sealing holes by means of a nickel acetate solution, after the step of conducting the further anodic oxidation for forming the anodized stained membrane.

16. The method as defined in claim 10, wherein the photo-sensitive layer is composed of a charge generating sublayer and a charge transmitting sublayer, and wherein the anodized stained membrane is made to have a thickness of 0.5–3μm.

17. The method as defined in claim 10, wherein the anodized stained membrane is formed by anodic oxidation in a mixed solution containing one or more of organic acids selected from a group consisting of oxalic acid, maleic acid, phenolsulfonic acid, sulfophthalic acid, sulfosalicylic acid and cresolsulfonic acid, and wherein the anodized stained membrane is made to have a thickness of 0.5–3μm.

18. The method as defined in claim 10, wherein the anodized stained membrane is formed by anodic oxidation in a mixed solution containing one or more of organic acids selected from a group consisting of oxalic acid, maleic acid, phenolsulfonic acid, sulfophthalic acid, sulfosalicylic acid and cresolsulfonic acid, and wherein the anodized stained membrane is made to have a thickness of 0.5–3 μm, with the anodized sulfate membrane being made to have a thickness of 5–10μm.

19. The method as defined in claim 10, wherein the anodized stained membrane is formed by anodic oxidation in a mixed solution containing one or more of organic acids selected from a group consisting of oxalic acid, maleic acid, phenolsulfonic acid, sulfophthalic acid, sulfosalicylic acid and cresolsulfonic acid, and wherein the anodized stained membrane is made to have a thickness of 0.5–3μm, with the anodized sulfate membrane being made to have a thickness of 5–10μm, and the method further comprising the step of sealing holes by means of a nickel acetate solution, after the step of conducting the further anodic oxidation for forming the anodized stained membrane.

20. A method of processing a raw aluminum plate from which an aluminum substrate of a photosensitive device is manufactured for use in electrophotography employing as its light source a coherent monochromatic light beam, wherein the photosensitive device further comprises a photosensitive layer formed on the substrate and composed of a charge generating sublayer and a charge transmitting sublayer, the method comprising the steps of:

conducting anodic oxidation of the raw aluminum plate in a sulfuric acid bath so as to form a sulfate membrane having a thickness of 5–10μm;

then conducting anodic oxidation of the raw aluminum plate on which the sulfate membrane has been formed, in an organic acid bath capable of staining the raw aluminum plate and containing one or more of organic acids selected from a group consisting of oxalic acid, maleic acid, phenolsulfonic acid, sulfophthalic acid, sulfosalicylic acid and cresolsulfonic acid, so that an anodized stained membrane is formed on the surface of said raw aluminum plate to provide the aluminum substrate, wherein the anodized stained membrane is made to have a thickness of 0.5–3μm; and subsequently sealing holes by means of a nickel acetate solution, after the step of conducting the further anodic oxidation for forming the anodized stained membrane.

* * * * *